US006457607B1

(12) United States Patent
Andrea et al.

(10) Patent No.: US 6,457,607 B1
(45) Date of Patent: Oct. 1, 2002

(54) DISPENSING UNIT FOR A FLUID DISPENSING MACHINE, COMPRISING A VARIABLE-VOLUME PUMPING CHAMBER, AND MACHINE COMPRISING SAID DISPENSING UNIT

(75) Inventors: Parrino Andrea, Mirandola (IT); Manfredini Giorgio, Cavezzo (IT); Mazzalveri Leopoldo, Urbino (IT)

(73) Assignee: Corob International AG, Aarau (CH)

( * ) Notice: Subject to any disclaimer, the term of this patent is extended or adjusted under 35 U.S.C. 154(b) by 0 days.

(21) Appl. No.: 09/529,465

(22) PCT Filed: Oct. 7, 1998

(86) PCT No.: PCT/EP98/06347

§ 371 (c)(1),
(2), (4) Date: Jun. 19, 2000

(87) PCT Pub. No.: WO99/19628

PCT Pub. Date: Apr. 22, 1999

(30) Foreign Application Priority Data

Oct. 13, 1997 (IT) ..... BO97A0609

(51) Int. Cl.[7] ..... B67D 5/08

(52) U.S. Cl. ..... 222/63; 222/209; 222/214

(58) Field of Search ..... 222/63, 214, 209, 222/333, 334, 341

(56) References Cited

U.S. PATENT DOCUMENTS

| | | | | |
|---|---|---|---|---|
| 2,849,159 | A | 8/1958 | Kaufmann | 222/214 |
| 5,230,443 | A | 7/1993 | Du | 222/334 |
| 5,435,466 | A | 7/1995 | Du | 222/334 |
| 5,464,120 | A | 11/1995 | Alpers et al. | 222/63 |
| 5,638,986 | A | 6/1997 | Tuominnen et al. | 222/63 |

*Primary Examiner*—Philippe Derakshani
(74) *Attorney, Agent, or Firm*—Flynn, Thiel, Boutell & Tanis, P.C.

(57) ABSTRACT

A dispensing unit for a fluid dispensing machine comprises at least an inlet duct and an outlet duct for fluid products, connected to a variable-volume pumping chamber comprising at least one flexible wall. Two non return valves mounted in counter-phase are located in the inlet and outlet ducts, respectively. The pumping chamber is coupled to actuator means comprising a stepper motor, a screw-nut screw unit and a carriage. The carriage moves the pumping chamber from a zero position in which the chamber has a maximum volume to an upper limit in which the chamber has a minimum volume. An optic sensor defines the zero point of the pumping chamber so as to guarantee precision and repeatability of the dispensing operations.

18 Claims, 3 Drawing Sheets

DISPENSING UNIT FOR A FLUID DISPENSING MACHINE, COMPRISING A VARIABLE-VOLUME PUMPING CHAMBER, AND MACHINE COMPRISING SAID DISPENSING UNIT

TECHNICAL FIELD

The present invention relates to the field of dispensing machines intended to dispense and/or meter more or less viscous fluid products, such as for example paints, colorants, inks, and the like.

BACKGROUND ART

Prior art in the above sector comprises dispensing machines that run according to various operating principles. One fairly widespread type of known machine comprises multiple reservoirs for colorant fluids, connected to a dispensing circuit. Each fluid product is drawn from its respective reservoir by a positive-displacement pump and delivered to a corresponding three-way two-position distributing valve. When the valve is in an inactive position, the fluid is returned to its respective reservoir through a recirculation duct. When it is necessary to dispense a pre-set amount of fluid, the valve is set to an active position so as to deliver the fluid from the reservoir to a dispensing nozzle. This type of machine provides excellent results in terms of precision repeatability and reliability Of results over time. However, the use of a pump and solenoid valve for each reservoir of fluid product raises the overall cost of the machine, in terms of both manufacture and servicing. Another known type of dispensing machine for fluid products, especially colorant fluids, comprises a series of reservoirs connected to or integrated with syringe-type dispensing pumps, comprising plungers axially movable inside respective cylinders, the pumps being usually arranged around the circumference of a rotating drum. To distribute a pre-set amount of fluid product into a container, it is necessary to rotate the drum until the appropriate syringe is aligned with the container. Generally, therefore, in machines of this known type it is impossible to dispense multiple fluid products simultaneously into the same container, which leads to low productivity for machines of this known type. Various solutions have been proposed to overcome the above problem all fairly complicated and costly to manufacture and service. In addition, one intrinsic problem with known syringe-type machines lies in the difficulty of providing sufficient sliding seals between the plungers and cylinders to ensure good precision and repeatability over time in dispensing and metering. Also, use of these machines with aggressive or abrasive fluids leads to rapid wear on the sliding seals and thus a decline in the machine performance, which can only partly be overcome by constant servicing, which heavily increases the running costs of the machine.

DISCLOSURE OF THE INVENTION

The object of the present invention is to overcome the above problems with the prior art by providing a dispensing machine to dispense and/or meter fluid products which is easy and economical to manufacture and service, and which provides high precision and reliability over time, even when using aggressive, corrosive or abrasive fluid products. Another object of the present invention is to provide a machine that is compact in size with satisfactory productivity performance, especially—but not exclusively—when dispensing limited amounts of fluid products. A further object of the present invention is to provide a machine comprising a plurality of independent dispensing units which are easy to manufacture and install on the machine and which can be quickly replaced if needed, even by unskilled personnel, for example even the machine user. In order to achieve the above objects, the present invention relates to a dispensing unit having the characteristics described below. The invention also relates to a dispensing machine to dispense and/or meter fluid products, comprising a plurality of dispensing units of the above type.

According to a particular feature of the present invention, the dispensing unit comprises a pumping chamber with flexible walls, in particular but not exclusively bellows-like walls. In one particular embodiment, the pumping chamber is activated by a linear actuator in order to provide a linear proportion between the actuator stroke and the amount of product dispensed. According to a further particular feature, the linear actuator comprises a stepper motor to provide a linear proportion between the number of motor steps and the amount of fluid dispensed. Another special feature lies in the fact that, with the dispensing unit of the present invention, the pressure in the delivery duct to the dispensing nozzle drops immediately as soon as dispensing is interrupted, which prevents dripping and droplets at the nozzle.

According to another feature of the invention, the dispensing unit is set to filling position at the end of each dispensing, making the dispensing unit immediately available for the next delivery.

Yet another feature of the invention is that the dispensing unit comprises an optic limit sensor, which defines the zero point for the pumping unit. This feature makes it possible to achieve high repeatability of the dispensing process of a fluid product by the dispensing unit.

Another feature of the dispensing unit lies in the fact that the intake and dispensing strokes may take place at different speeds, to improve the machine productivity by reducing the time needed to refill the pumping chamber, yet without sacrificing precision during the dispensing phase.

BRIEF DESCRIPTION OF THE DRAWINGS

Further features and advantages shall become apparent from the description below of one preferred embodiment, with reference to the enclosed figures, provided solely as nonlimiting examples, wherein.

DETAILED DESCRIPTION

With reference now to the figures, a dispensing machine to dispense and/or meter fluid products comprises a body 10, at the front of which is located at least one nozzle or group of dispensing nozzles 11, of a generally known type, reached by dispensing ducts 12 that serve to convey preset amounts of fluid products into one or more cans C, simultaneously or sequentially. The dispensing machine body may take on different overall shapes and configurations, primarily dictated by the transport or handling needs of the cans C, as well as considerations of ergonomics and appearance, which are not especially relevant to the present invention. For these reasons the overall structure of the machine is not described in detail in the remainder of this description.

Figure 1:
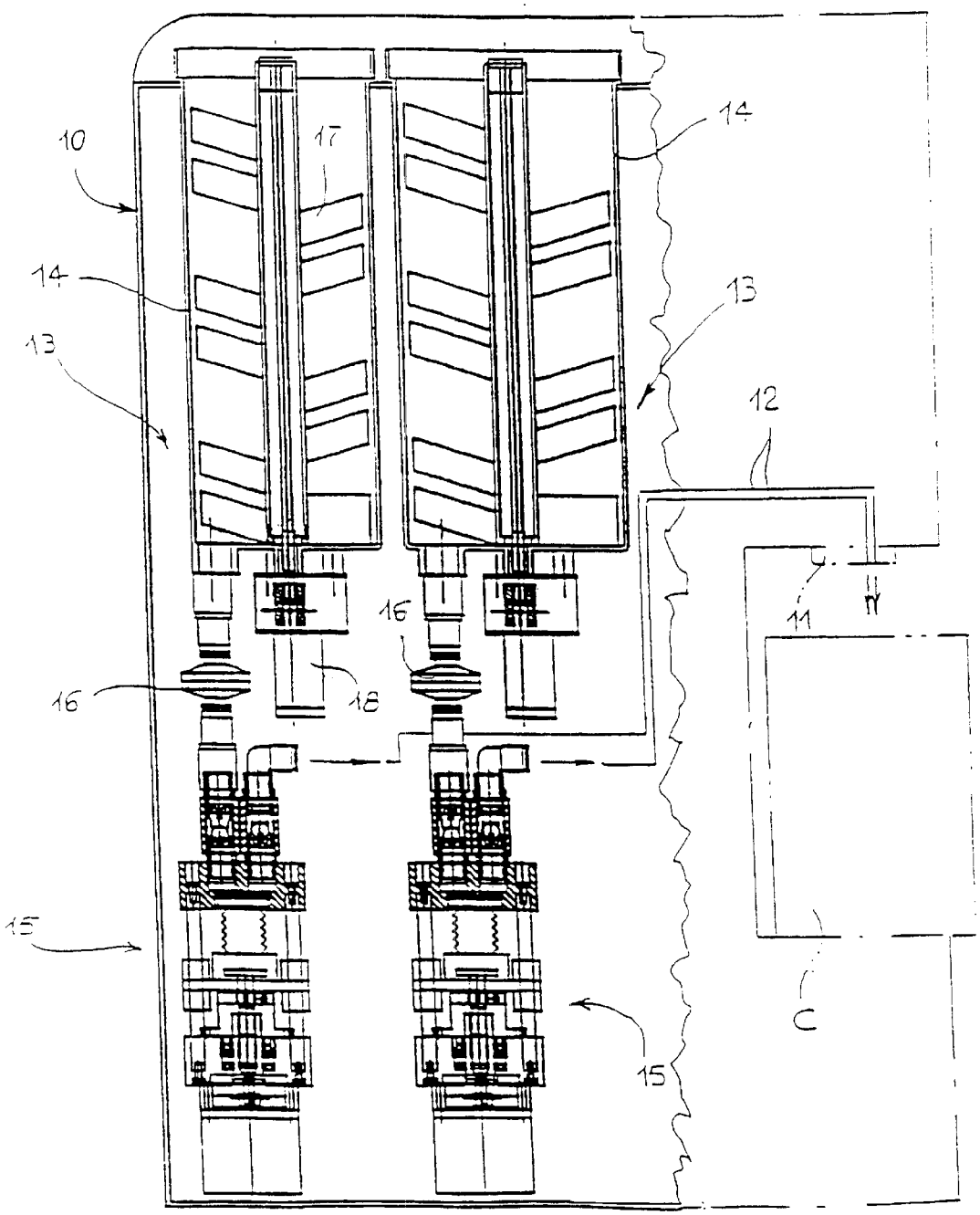
FIG. 1 is a longitudinal schematic cross-section of a pair of dispensing units of the present invention, mounted inside a body of a dispensing machine.

Inside the dispenser body 10, dispensing units 13 are located, each of which comprises a reservoir 14 for a fluid product, connecting to a pumping unit 15, which in turn is connected to its respective dispensing duct 12 leading outside at the nozzle or group of nozzles 11. A filter 16 is preferably inserted between the reservoir 14 and the corresponding pumping unit 15. A stirring member 17, of a generally known type—for instance, a rotary blade type as illustrated in FIG. 1, activated by a motor unit 18 attached at the lower end of the reservoir itself—may be mounted inside the reservoir 14.

Figure 2:
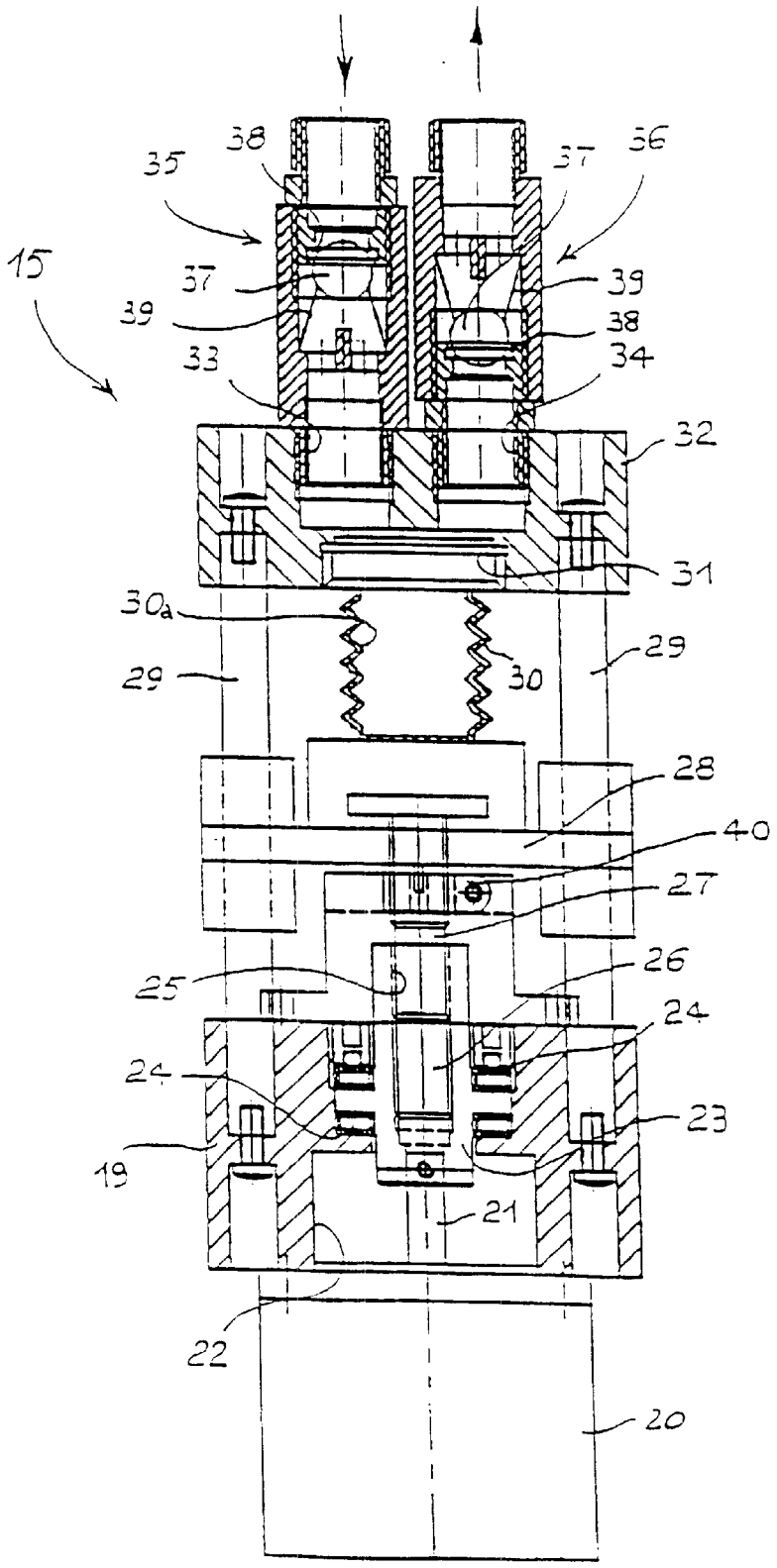
FIG. 2 is an enlarged longitudinal cross-section of the pumping unit of the present invention.

The generic pumping unit 15, illustrated in greater detail in FIG. 2, comprises a base support 19 beneath which is a stepper motor 20, whose motor shaft 21 extends into a cavity 22 provided in the base support 19. The motor shaft 21 is connected to an actuator member 23, rotatably mounted in the base support and supported therein by a pair of axial bearings 24. A nut screw 25 is axially located in the actuator member 23, into which is screwed the threaded end 26 of a drive shaft 27 acting as a drive screw. The screw-nut screw coupling is preferably of the irreversible type. The drive shaft 27 is fixed to a carriage 28 that slides along vertical guide bars 29 fixed to the base support 19, upon which a position sensor 40 is also mounted, the function of which shall become clear hereinbelow.

The lower base of a bellows-like pumping chamber 30 is fixed to the carriage 28; the internal cavity 30*a* of the chamber communicates with a manifold 31 provided inside an upper cross-beam 32, fixed to the top end of the guide bars 29. The manifold 31 in turn communicates with an inlet 33 and an outlet 34, which communicate with the reservoir 14 and the dispensing duct 12, respectively, with the interposition of two respective non-return valves 35 and 36. In detail, the non-return valves each comprise a spherical shutter 37 that urges against, a circular valve seat 38 thanks to the action of a resilient element 39, preferably a pre-set helical spring.

Figure 4:
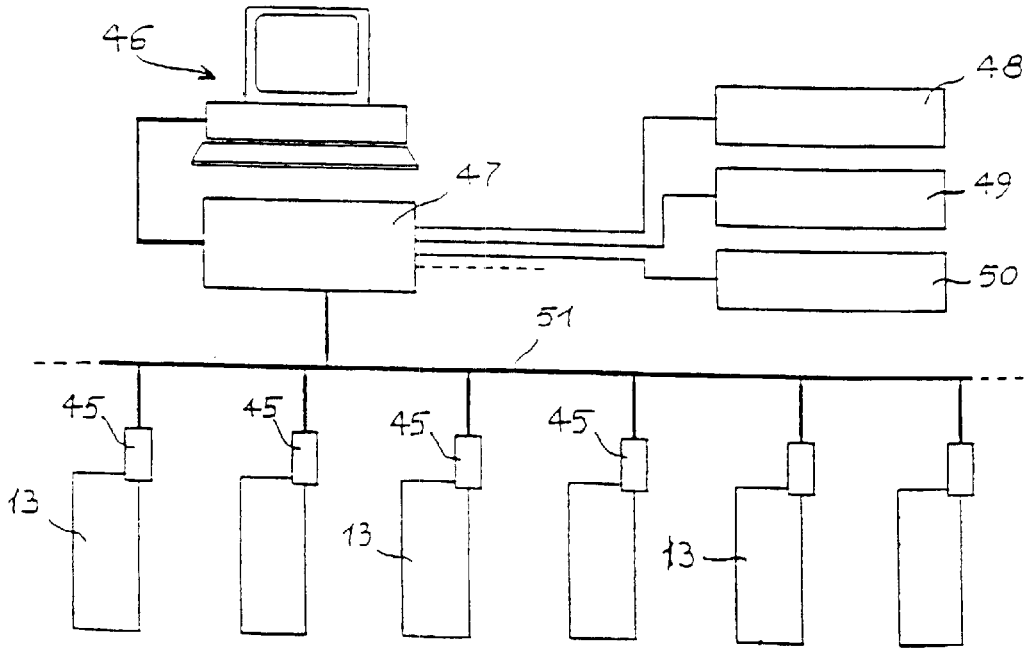
FIG. 4 is a diagram similar to FIG. 3, illustrating a control system especially suited to simultaneous dispensing of products.

The stepper motor may be controlled by an electronic control system 45 (shown schematically in FIG. 4) mounted on the dispensing unit 13, which may also control the motor unit 18 of the stirring member 17. In the embodiment illustrated in the diagram in FIG. 4, the control systems 45 communicate with a central processing unit 46, preferably installed on the machine and capable of sending information to activate the control system 45 of the appropriate dispensing unit 13 following a dispensing request for a preset amount of one or more fluid products. In particular, the central processing unit 46 acts as the machine/user interface and is connected by any known data transmission system to a circuit block 47, responsible for controlling and managing the members of the dispensing machine. The circuit block 47 is connected in known ways to the machine resources, such as a dispensing nozzle humidifier device 48, an actuator 49 for a shelf to adjust the container height, or even a sensor system 50 to detect the presence of the container in the dispensing compartment of the machine, as well as others. In the case of FIG. 4, the circuit block 47 connects via a data network connection 51 with the control systems 45 placed on each dispensing unit 13. In this case, it is possible to simultaneously activate two or more dispensing units 13, and thus simultaneously dispense two or more products.

Figure 3:
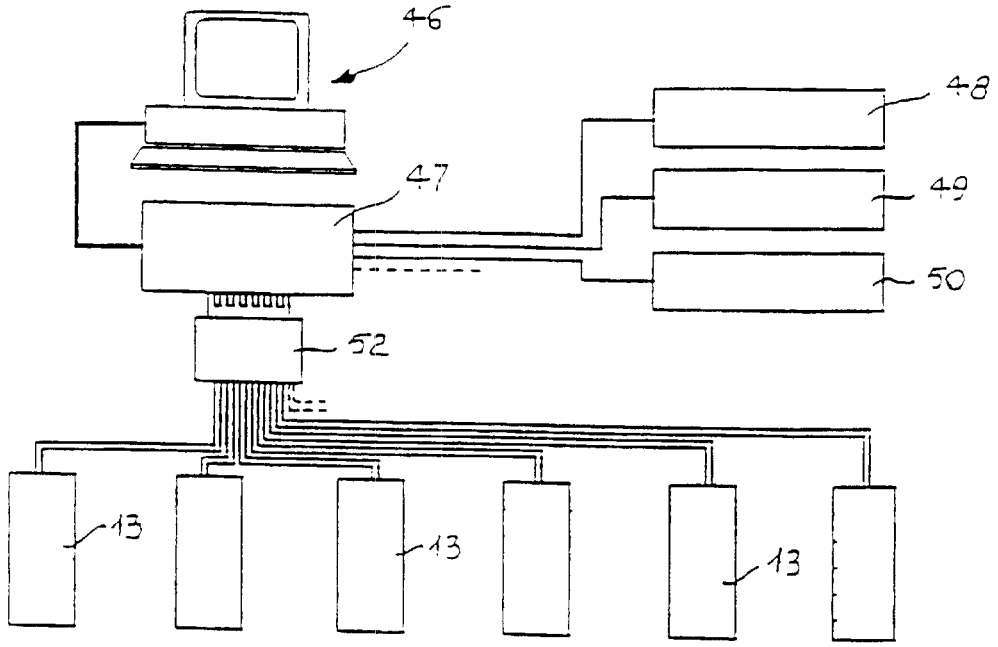
FIG. 3 is a diagram of the control system for a dispensing machine of the present invention, especially suited to sequential dispensing of products.

In another embodiment, shown schematically in FIG. 3, the circuit block 47 is connected to an I/O card 52 that directly controls, without the interposition of the control systems 45, the dispensing units 13 and receives information signals from each unit, for example the signals emitted by each position sensor 40. This solution makes it possible to manufacture a dispensing machine decidedly more economical than the one shown in FIG. 4, as it is not necessary to equip each dispensing unit 13 with its own independent control logic. Although the control system in FIG. 3 does not allow for the simultaneous dispensing of products, the precision and repeatability of the dispensing suffer no decline, as they are determined by the features of each dispensing unit 13.

During periods of inactivity, when no product dispensing is in progress, all dispensing units on the machine are in a resting position, where the bellows-like pumping chambers 30 are open to their maximum extension and completely filled with fluid product. In these situations, the carriages 28 are positioned at the lower end of their stroke as detected by the position sensors 40. The electronic systems installed on the machine are set up to process information regarding amounts of fluid products to be distributed in terms of either volume or weight, and translate them by means of conversion tables into information on the number of cycles and fractions of cycles needed in order for the pumping chamber 30 to transfer the desired amount of fluid product to the corresponding outlet duct 12. This conversion is simplified by the fact that the ratio between the volume of product transferred to the outlet following a compression of the bellows 30 is essentially directly proportional to the axial movement of the drive shaft 27, and thus the number of steps of the stepper motor 20.

When the central processing system 46 sends dispensing information to a specific pumping unit 15 via the circuit block 47, the local electronic control system 45 or the I/O board 46 activates the stepper motor 20 to control the movement of the carriage 28, and thus the compression of the bellows-like pumping chamber 30. Since the cavity 30*a* of the pumping chamber is already full of fluid product, the dispensing unit is immediately ready to dispense as soon as it receives the activating information from the central processing unit.

If the volume of the fluid product to be dispensed is less than the displacement of the bellows-like pumping chamber 30, the stepper motor 20 is controlled in one rotation direction for a number of steps sufficient to reduce the volume of the pumping chamber by an amount equal to the volume of product to be distributed. Since the fluid products to be dispensed are essentially non-compressible, the pressure generated inside the chamber 30*a* as soon as the carriage 28 is raised to compress the bellows 30 is enough to overcome the resistance of the spring 39 of the non-return valve 36, thereby opening it, and thus causing fluid product to leave the dispensing duct 12. This duct is normally full of product and is preferably short to reduce the effects of load loss on the precision and linearity of the dispensing unit. When dispensing is complete, the stepper motor 20 is controlled in the opposite direction until the sensor 40 signals that the carriage 28 has reached the lower end of its stroke. As soon as the motor 20 reverses its direction, the pressure inside the chamber 30*a* drops, causing the non-return valve 36 to close immediately. This also causes the pressure to drop in the dispensing duct 12, and, due to the slight shift by the shutter 37, probably also creates a slight vacuum in the duct 12 sufficient to prevent the formation of drops or leaks of fluid product at the nozzle 11. During the return stroke of the carriage 28 toward the lower end of its stroke, the volume of the chamber 30*a* of the bellows 30 increases, thereby drawing fluid product from the reservoir 14 through the non-return valve 35 which opens. As shown in FIG. 1, the reservoir 14 is preferably located above the corresponding pumping unit 15 and is connected to it by an essentially vertical duct with a fairly wide cross-section. All of this facilitates penetration of the fluid product into the chamber 30*a* when the carriage 28 is lowered, without the risk of cavitation. The fact that it is so easy to draw product from the reservoir 14 makes it possible to control the return stroke of the carriage 28 at a greater speed than the dispensing stroke.

This feature is specially advantageous when the amount of product to be dispensed is greater than the displacement of the bellows. In this case, the electronic control system controls the stepper motor 20 so that it completes one or more full dispensing cycles, each of which consists of a complete stroke by the carriage 28 upwards and a return downward stoke to the lower limit position detected by the position sensor 40. In order to deliver the desired amount of fluid product, the last dispensing stroke of the carriage 28 shall usually be a partial stroke, followed by the return of the carriage 28 to the lower end of its stroke, in resting position. The fact that the return strokes of the carriage 28, during which the nozzle 11 has stopped dispensing product to allow the chamber 30*a* of the accordion 30 to refill, take place at a higher speed than the delivery strokes reduces refilling times and thus increases the overall productivity of the dispensing machine.

The presence of the position sensor 40 makes it possible to easily implement an important control function of the proper operation of the dispensing unit, and consequently a procedure to correct any malfunctions. Indeed, it is necessary simply to count the number of motor steps needed to return the carriage to home position, or the lower end of its stroke—indicated by the position sensor—and compare it to the number of steps taken by the motor to carry out the carriage forward stroke. This immediately checks for any operating errors if the two numbers do not match. In this case, the control system can generate an error signal and indicate the malfunction to the user. In addition, if the number of steps in the dispensing stroke is lower than in the return stroke, the processing system can automatically activate the step motor again for the number of steps equal to the difference found, to deliver the missing amount of product and thus complete the dispensing operation, which would otherwise be defective.

To increase the productivity of the machine, it is also possible to parallel control several dispensing units, as shown in the example of the diagram in FIG. 4, so that several fluid products may be dispensed simultaneously into the same container C through a shared set of nozzles 11. This need is especially felt in the-paint, enamel, etc. manufacturing industry, where it is normal to deliver preset amounts of various colorant products into a container C to obtain a finished product having the desired color shade.

The fact that the screw-nut screw connection which acts as a linear actuator between the stepper motor 20 and the carriage 28 is irreversible allows the carriage 28 to remain in its position even in the event of a temporary, accidental electrical power loss. In other words, the type of screw-nut screw used does not allow the carriage to move except after the stepper motor has been activated in one rotation direction or the other. Each dispensing unit 13 is independent and may easily be replaced even by unskilled personnel in the event of a breakdown, since one must simply connect the electrical power and communication connectors of the dispensing duct 12. The bellows-like pumping chamber 30 may be made using materials that resisist aggression by fluid products, for example fluoride-based polymers. The absence of sliding seals ensures high reliability even in the presence of abrasive fluids. Of course, the geometry of the pumping chamber may vary from the example shown: for example, it may comprise a different type of variable-volume chamber such as one with flexible walls, or a diaphragm, or similar solutions. In addition, the same carriage may control more than one pumping chamber.

Of course, the principle of the invention remaining the same, the embodiments and development details may vary widely from those described and illustrated without exceeding the extent of the present invention.

What is claimed is:

1. Dispensing unit for a fluid dispensing machine comprising at least one inlet duct and one outlet duct for fluid products, connected to a variable-volume pumping chamber having at least one flexible wall, an actuator provided to selectively move the pumping chamber from a zero position in which the chamber has a maximum volume to a limit position in which the chamber has a minimum volume, said actuator moving the pumping chamber towards the zero position at a first speed and towards the limit position at a second speed which is different from the first speed, non-return valves arranged in the inlet and outlet ducts to allow fluid product to enter and leave the pumping chamber as the pumping chamber moves towards the zero position and towards the limit position, respectively.

2. Dispensing unit according to claim 1, wherein the flexible wall is bellows-like.

3. Dispensing unit according to claim 1, wherein the actuator comprises a linear actuator for activating the pumping chamber.

4. Dispensing unit according to claim 3, wherein the linear actuator comprises a stepper motor.

5. Dispensing unit according to claim 1, wherein the non-return valves are mounted in counter-phase in the inlet and outlet ducts.

6. Dispensing unit according to claim 1, further including an optic sensor that defines the zero position of the pumping chamber.

7. Dispensing unit according to claim 1, further including at least one reservoir placed near and above the pumping chamber and connected to the inlet duct.

8. Dispensing unit according to claim 4 wherein said pumping chamber is mounted on a carrier disposed adjacent said actuator, said carrier being slidingly supported on a pair of guides fixed between a spaced-apart pair of supports of said dispensing unit.

9. Dispensing unit according to claim 8 wherein said actuator includes a drive screw fixed to said carrier and an actuator member rotatably mounted on a lower one of said supports for movement with a drive shaft of said stepper motor, said actuator member including a threaded portion which engages said drive screw to cause movement of said carrier and said pumping chamber into said zero and limit positions depending upon the rotational direction of said drive shaft.

10. A fluid dispensing machine comprising at least one fluid product dispensing nozzle and at least one dispensing unit, said dispensing unit including an inlet duct and an outlet duct in communication with a variable-volume pumping chamber defined by a flexible wall, an actuator for selectively moving the pumping chamber between a zero position in which the pumping chamber has a maximum volume and a limit position in which the pumping chamber has a minimum volume, said actuator moving the pumping chamber towards the zero position at a first speed and towards the limit position at a second speed which is different from the first speed, non-return valves mounted in the inlet and outlet ducts to allow fluid product to enter and leave the pumping chamber as the pumping chamber moves towards the zero position and towards the limit position, respectively, said outlet duct leading outside said machine through said nozzle.

11. Fluid dispensing machine according to claim 10, wherein said dispensing unit includes a base upon which a pair of upright and generally parallel guides are mounted, a carrier slidably mounted on said guides and mounting thereon said pumping chamber and a threaded drive screw, and a stepping motor including a rotatable drive shaft, said actuator being mounted within said base for rotation relative thereto along with said drive shaft and threadingly engaging said drive screw to convert rotary motion of said drive shaft into linear motion so as to cause movement of said carrier and said pumping chamber between said zero and limit positions.

12. Dispensing machine according to claim 10, further including a central processing unit that transmits significant data on the amount of product to be dispensed with each dispensation to a control unit, the control unit controlling the actuator to selectively move the pumping chamber of the dispensing unit.

13. Dispensing machine according to claim 12, wherein the control unit controls the movement of the pumping chamber towards the zero position at the end of each dispensing.

14. A fluid dispensing unit for a fluid dispensing machine, said unit comprising:

an inlet duct for receiving fluid from a reservoir and an outlet duct for communication with a product dispensing nozzle;

a base mounting thereon a pair of generally parallel and upright guide elements;

a carriage disposed for sliding movement along said guide elements;

a bellows defining a pump chamber therein and having one end fixed to said carriage and an opposite end in communication with said inlet and outlet ducts;

a electric motor mounted on said base and having a rotatable drive shaft; and an actuator mounted on said base which converts rotary motion of said drive shaft into linear motion to cause linear movement of said carrier and said bellows fixed thereto between a first position in which the pump chamber contains a maximum volume of product and a second position in which the pump chamber contains a minimum volume of product.

15. The dispensing unit of claim 14 further including a vertically oriented drive screw fixed to said carriage, said actuator being connected to said drive shaft for rotation therewith and being rotatably mounted within and relative to said base, said actuator mounting thereon a nut which threadingly engages said drive screw to cause raising or lowering of said carriage depending upon the direction of rotation of said drive shaft.

16. The dispensing unit of claim 15 further including an upper support mounted on upper ends of said guide elements and defining therein a manifold, said opposite end of said pump chamber communicating with said manifold which in turn communicates with said inlet and outlet ducts.

17. The dispensing unit of claim 16 wherein said inlet and outlet ducts each include a non-return valve therein to respectively allow product to enter and exit the pump chamber as said bellows moves into said first position and into said second position, respectively.

18. The dispensing unit of claim 17 further including a control unit which causes movement of said bellows at a first speed during movement into said first position and causes movement of said bellows at a second speed during movement into said second position, said second speed being different from said first speed.

* * * * *